US011027914B2

(12) United States Patent
Tang

(10) Patent No.: US 11,027,914 B2
(45) Date of Patent: Jun. 8, 2021

(54) MODULAR INDEFINITE VOLUME COMBINED TANK

(71) Applicant: ShuLin Tang, Chengdu (CN)

(72) Inventor: ShuLin Tang, Chengdu (CN)

( * ) Notice: Subject to any disclaimer, the term of this patent is extended or adjusted under 35 U.S.C. 154(b) by 0 days.

(21) Appl. No.: 16/635,560

(22) PCT Filed: Dec. 28, 2018

(86) PCT No.: PCT/CN2018/124676

§ 371 (c)(1),
(2) Date: Jan. 31, 2020

(87) PCT Pub. No.: WO2019/205704

PCT Pub. Date: Oct. 31, 2019

(65) Prior Publication Data

US 2021/0032017 A1 Feb. 4, 2021

(30) Foreign Application Priority Data

Apr. 26, 2018 (CN) ..... 201810387365.2

(51) Int. Cl.

| | |
|---|---|
| ***B65D 90/04*** | (2006.01) |
| ***B65D 90/08*** | (2006.01) |
| *B65D 90/12* | (2006.01) |
| *B65D 90/54* | (2006.01) |

(52) U.S. Cl.
CPC ..... *B65D 90/046* (2013.01); *B65D 90/08* (2013.01); *B65D 90/12* (2013.01); *B65D 90/54* (2013.01); *B65D 2590/043* (2013.01)

(58) Field of Classification Search
CPC .... B65D 90/047; B65D 90/046; B65D 90/08; B65D 90/02; B65D 90/12; B65D 90/66; B65D 90/54
USPC ..... 220/1.6, 1.5, 565, 723, 721, 720, 62.21
See application file for complete search history.

(56) References Cited

U.S. PATENT DOCUMENTS

| | | | | |
|---|---|---|---|---|
| 3,827,136 A * | 8/1974 | Yamamoto | B63B 25/16 29/455.1 |
| 4,493,428 A * | 1/1985 | Mittelmann | B65D 90/08 220/1.5 |
| 6,398,053 B1 * | 6/2002 | Thornsen | B65D 90/046 220/1.5 |

(Continued)

FOREIGN PATENT DOCUMENTS

| | | |
|---|---|---|
| CN | 1786550 A | 6/2006 |
| CN | 104854002 A | 8/2015 |
| CN | 108455109 A | 8/2018 |

*Primary Examiner* — Robert J Hicks

(57) ABSTRACT

A modular indefinite volume combined tank is provided, including a tank body module, a tank bottom module and an inflating module, wherein the tank body module is formed by splicing a plurality of wall plates and connectors, and the wall plates and the connectors form a tank body. The tank bottom module includes a strip-type steel plate, concrete cloth, annular steel plate and a cement foundation. The strip-type steel plate is paved on the cement foundation, the annular steel plate is arranged in the upper side of the outer edge of the strip-type steel plate, the annular steel plate is encircled by a plurality of arc-shaped steel sheets, a ring of annular edge is arranged in the annular steel plate to be connected to the upper tank body, and a layer of concrete cloth is arranged between the lower side of the annular steel plate and the strip-type steel plate.

8 Claims, 5 Drawing Sheets

(56) References Cited

U.S. PATENT DOCUMENTS

2018/0327180 A1* 11/2018 He ..... F16S 1/10

* cited by examiner

MODULAR INDEFINITE VOLUME COMBINED TANK

FIELD OF THE INVENTION

This invention relates to the technical field of oil-gas field development, in particular to a modular indefinite volume combined tank.

BACKGROUND OF THE INVENTION

At present, universal liquid storage equipment applied to feed flow for oil exploitation is formed by square tank welded by steel plates, folded square tank or soft capsule. Such liquid storage monomer has small storage. To complete the exploitation, tens of or hundreds of tanks are usually needed for a construction site, occupying ⅓ of the site. Besides, one large storage tank featured large size with diameter up to 20-30 m and height up to 15-20 m is also applied for oil exploitation engineering. These tanks are welded layer by layer on site from bottom to top, but the disadvantages lie in long construction time, non-repeated disassembly and utilization, site construction only, difficult construction and poor safety, and the processing quality is hard to be guaranteed.

Thus, storage tank equipment that supports assembly and disassembly, repeated utilization and long-distance transport is urgently needed to adapt to the oil exploitation with small operation site, large liquid storage demand and frequent conversion of workplace. Currently, liquid storage tank that supports disassembly and re-utilization is commercially available in the market, such as Chinese patent with application No. 201520207708.4, which discloses a tank that can meet the above requirements, but with simple structure and poor strength and tightness if compared to the integral tank. With this kind of tank, the hydraulic value increases constantly as the height increases. Once a joint has any problem, the entire tank is easy to be break, so it carries some risk.

SUMMARY OF THE INVENTION

For the disadvantages of liquid storage tank for oil exploitation, the aim of the present invention is to provide a modular indefinite volume combined tank for oil field construction that can be combined for diameter adjustment to be convenient to detach, repeated in use and short in construction time.

The technical solution of the present invention is as follows:

A modular indefinite volume combined tank is provided, which includes a tank body module, a tank bottom module and an inflating module.

The tank body module is formed by splicing a plurality of wall plates and connectors, the wall plates are strip plates, four sides of the plates are arranged with frame, and the two frames in the width direction are arranged with a connector, the connector is of a dumbbell structure; the connector includes a fixing bolt, an inner connecting piece and an outer connecting piece, coaxial through-holes are arranged in the middle of the outer connecting piece and inner connecting piece, the fixing bolt passes through the through-hole of the outer connecting piece and inner connecting piece for fixed connection, the outer connecting piece is of a dumbbell type, the inner connecting piece is of a groove type, the gap between the outer connecting piece and inner connecting piece is wide in the middle and narrow at both ends, the connector is fixed in the outer connecting piece and inner connecting piece, in order to realize the function that the connector fixes two adjacent wall plates; an annular tank body is formed by n wall plates and n−1 connectors.

The tank bottom module comprises a strip-type steel plate, concrete cloth, annular steel plate and a cement foundation, wherein the cement foundation is structured such that a round region is poured on the ground through cement; the strip-type steel plate is paved on the cement foundation, the strip-type steel plate is of a strip structure, the edge of the strip-type steel plate is arc-shaped, all strip-type steel plates form a steel plate area of a circular structure, the annular steel plate is arranged in the upper side of the outer edge of the strip-type steel plate, the annular steel plate is encircled by a plurality of arc-shaped steel sheets, a ring of annular edge is arranged in the annular steel plate to be connected to the upper tank body, and a layer of concrete cloth is arranged between the lower side of the annular steel plate and the strip-type steel plate.

The inflating module comprises a top cover and a liner, wherein the top cover is an inflated cover shaped like a pot cover, a cylindrical liner is connected below the top cover, the liner is also of an inflated structure, and inflating layers are arranged in the liner and the top cover, the bottom of the liner is arranged with a liquid inlet/outlet, the wall plate corresponding to the liquid inlet/outlet is arranged with an opening, the liquid inlet/outlet of the liner is arranged with quick coupling; an acid or alkali resistant layer is arranged inside the liner and the top cover; the contact between the top cover and the liner is arranged with an inflating port, the wall plate corresponding to the side face of the inflating port is arranged with an opening, and the opening is arranged with inflating connector.

Furthermore, the bottom outer edge of the top cover is arranged with a ring of rain shelter, the rain shelter is of a solid structure, the bottom of the top cover inclines towards the inclined lower part to cover the upper edge of the tank body.

Furthermore, with regard to the steel plate area of a circular structure formed by strip-type steel plates, the diameter is 1.5-2 times of the external diameter of the annular steel plate.

Furthermore, the cement foundation is externally arranged with a ring of cement cofferdam, the cofferdam is of a slope structure, part of the cofferdam is arranged at the edge of the steel plate area of a circular structure formed by strip-type steel plates, in order to compress the strip-type steel plate tightly for further fixation; meanwhile, the edge of the concrete cloth is set up on the upper side of the cofferdam, in order to realize seepage-proofing.

Furthermore, multiple reinforcing ribs are arranged on the wall plate.

Furthermore, the reinforcing ribs of the wall plate are arranged horizontally, and the space between two adjacent reinforcing ribs is arranged with increasingly narrowed distance from top to down, so as to improve the resistance of the lower part of the tank body against water pressure.

Furthermore, the inner sides of the outer connecting piece and inner connecting piece are both arranged with sealing strips, the sealing strip on the outer connecting piece covers the inner side of the outer connecting piece, the sealing strip of the inner connecting piece covers the inner side of the inner connecting piece and the inner side face of the connector.

Furthermore, a bottom seal liner is further added below the liner, the bottom seal liner is of a bowl structure, and the top thereof is located below the liquid inlet/outlet.

The advantages of the present invention are as follows:

1. Apply standard connectors to achieve good sealing effect

The tank wall assembly of the modular indefinite volume combined tank applies standard connectors and bolted connection. The connector applies standard profiles and the bolt is with steel structure. All these can satisfy enough joint strength and reliability; in addition, rubber sealing strip is installed on the junction surface of the connector. With this connection, up to six sealing faces can be made to avoid liquid leakage in the liner.

2. Short installation time and simple maintenance

The modular indefinite volume combined tank is installed by standard connectors, the structure is simple and the sealing effect is excellent. The installation can be done by putting the bolt on the joint for fixation, which is rather simple. In addition, the weather has little impact on the installation process and the installation period is easy to be controlled. The maintenance of the modular indefinite volume combined tank is very simple.

3. Modular combined tank can expand the volume infinitely

The modular indefinite volume combined tank is formed by standard connectors and tank walls. The tank wall has no radian, so it is easy for processing. During assembly, different quantities of tank wall plates can be installed according to the well site condition to form tanks with varied volume, so as to facilitate the expansion and migration of tank body and the diameter adjustment to realize infinite volume.

4. Good anti-corrosion property

The tank, with acid or alkali resistant liner structure inside, is applicable to multiple liquids, which prolongs the service life of the tank.

5. Simple construction process

The modular indefinite volume combined tank has no radian, and assembling and welding processes are simple, which greatly reduce the processing difficulty and can save a lot of costs; while simple and quick installability saves a lot of labor charges, bringing the modular indefinite volume combined tank a big competitive advantage in price.

6. Excellent reusability

The wall of the modular indefinite volume combined tank is formed by standard tank wall plate and connector. We can disassemble or re-install the tank upon operation, and tank reutilization can be easily realized.

DESCRIPTION OF THE PREFERRED EMBODIMENTS

The preferred embodiments of the present invention will be described below in conjunction with the accompanying drawings. It should be understood that the preferred embodiments described herein are merely illustrative of this invention, rather than limiting the scope of this invention.

Figure 1:
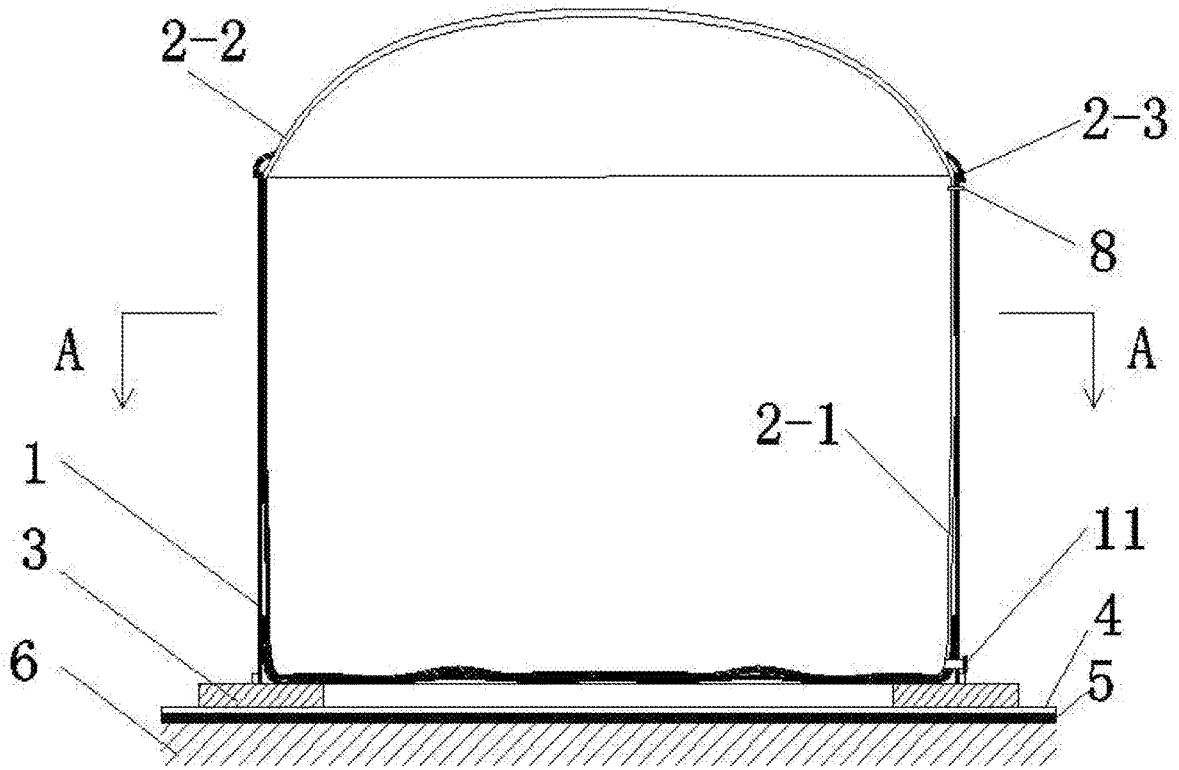
FIG. 1 is an internal section view of the present invention.
Figure 2:
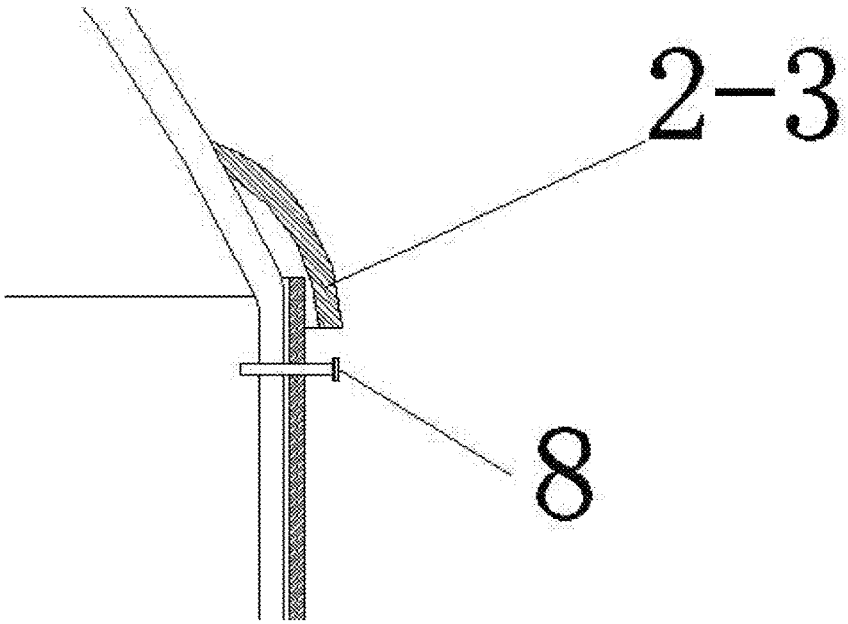
FIG. 2 is a detailed drawing of the top right corner of FIG. 1.
Figure 3:
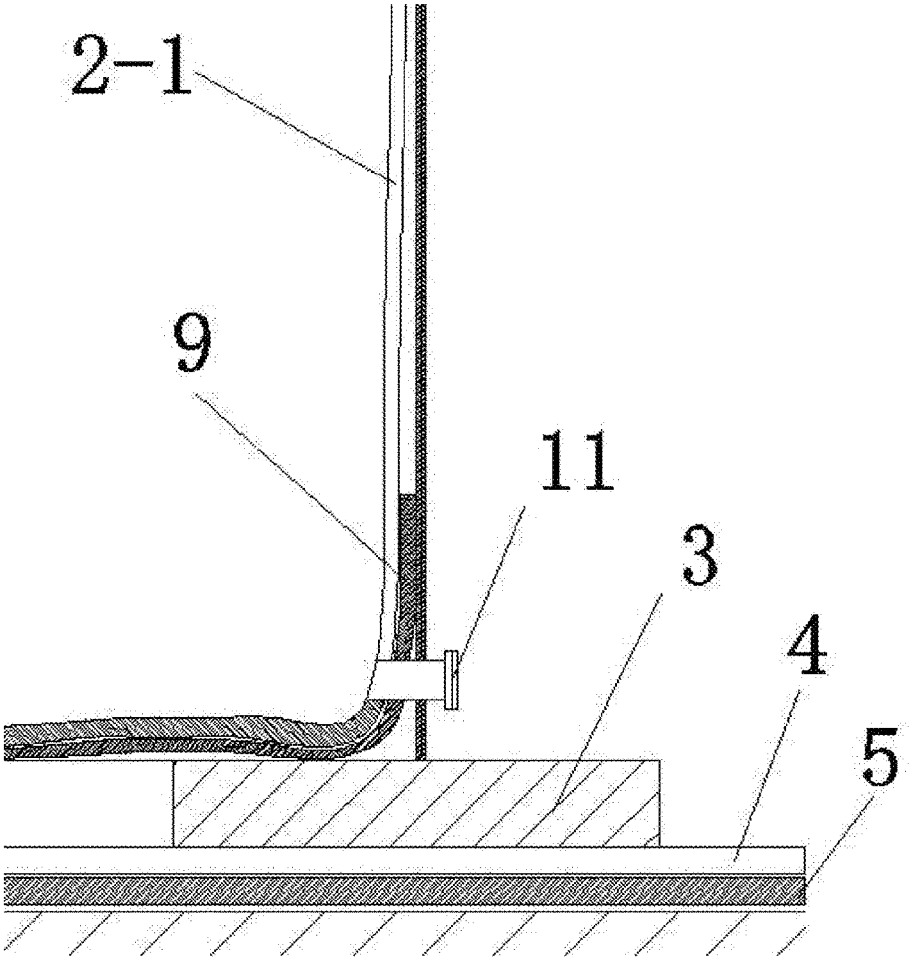
FIG. 3 is a detailed drawing of the lower right corner of FIG. 1.
Figure 4:
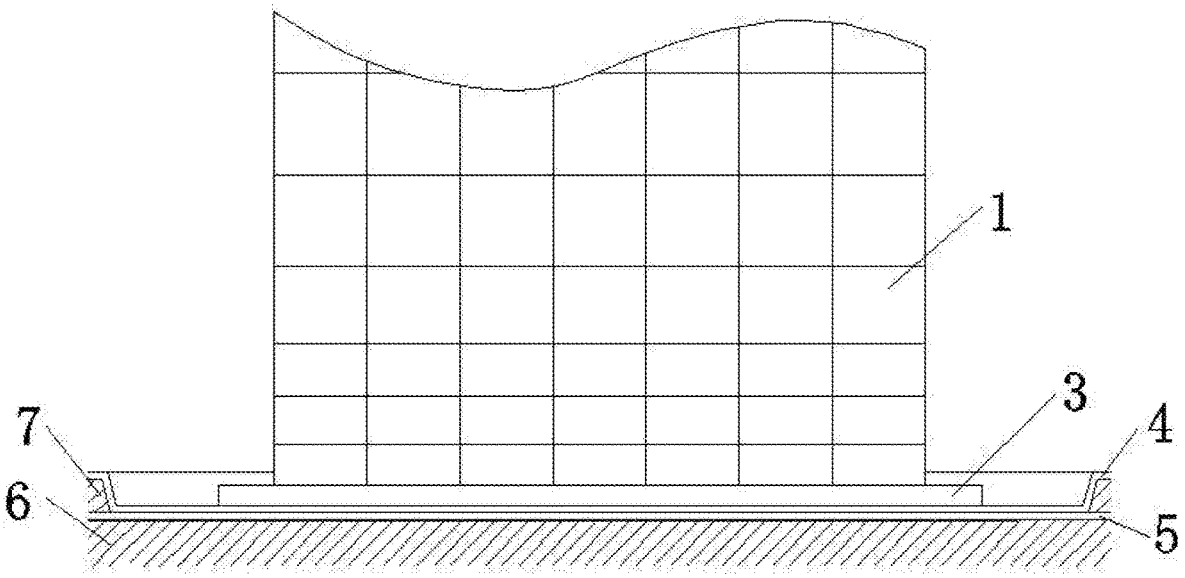
FIG. 4 is a detailed drawing of the tank bottom module.
Figure 5:
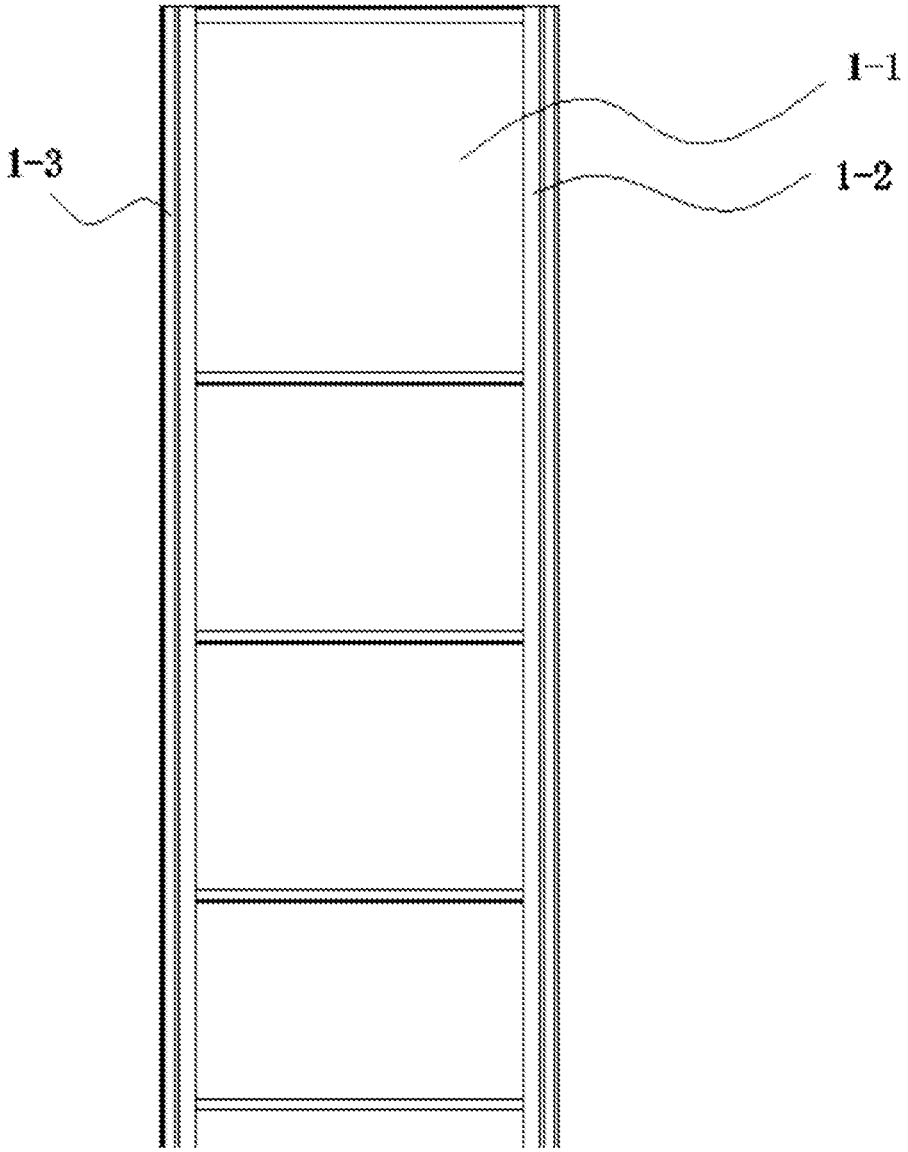
FIG. 5 is a front view of the structure diagram of wall plate.
Figure 6:
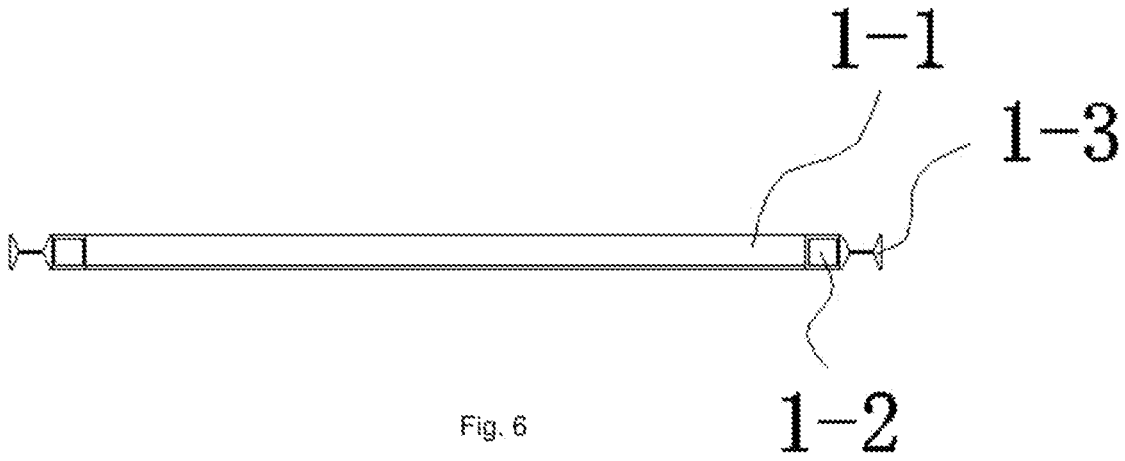
FIG. 6 is a top view of FIG. 5.
Figure 7:
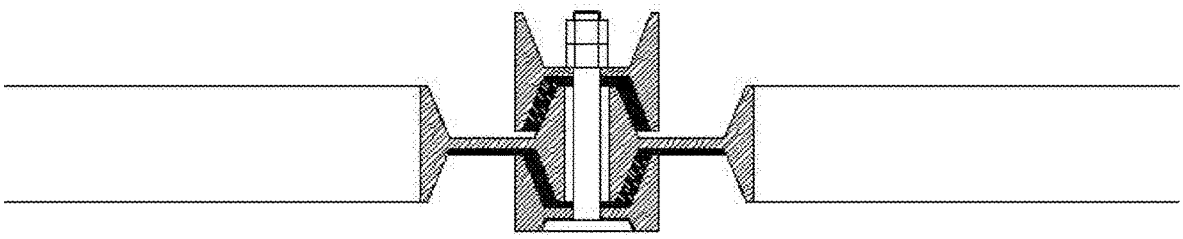
FIG. 7 is a structure diagram of the joint of two wall plates.
Figure 8:
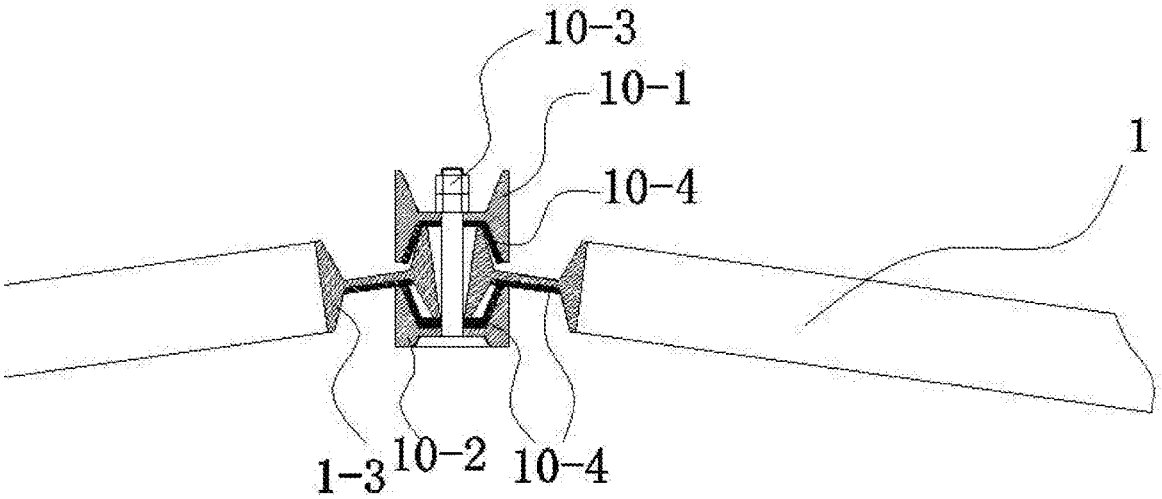
FIG. 8 is a structure diagram of the joint of wall plates after being connected as a tube body.
Figure 9:
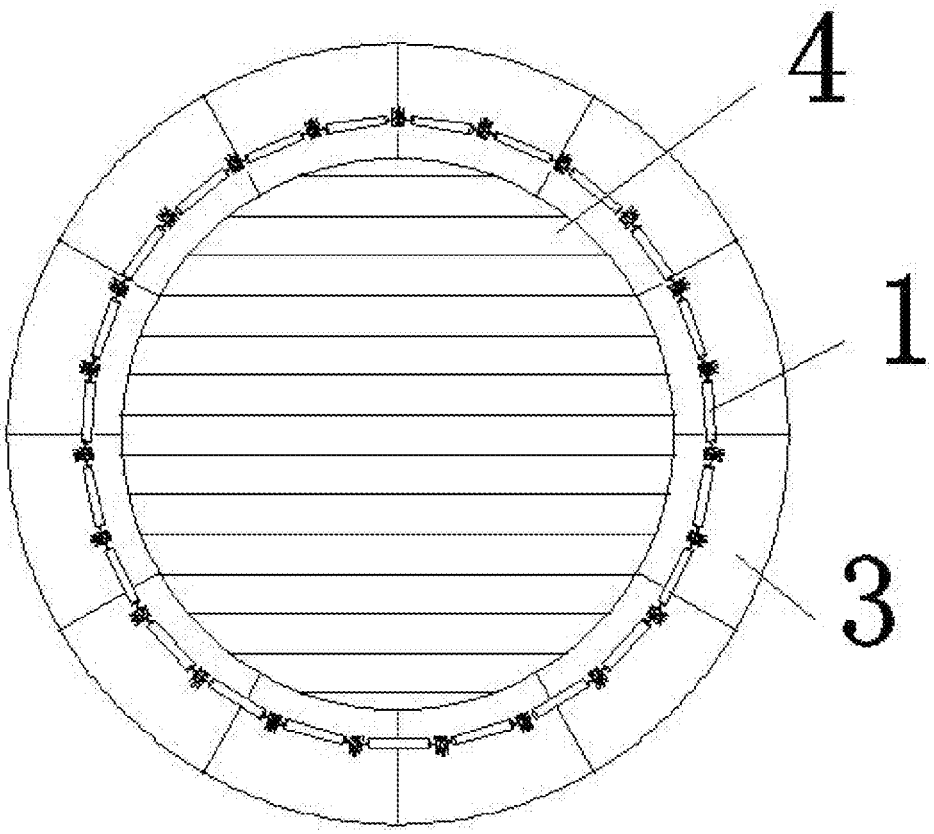
FIG. 9 is a schematic diagram of section A-A in FIG. 1 (concrete cloth concealed).
Figure 10:
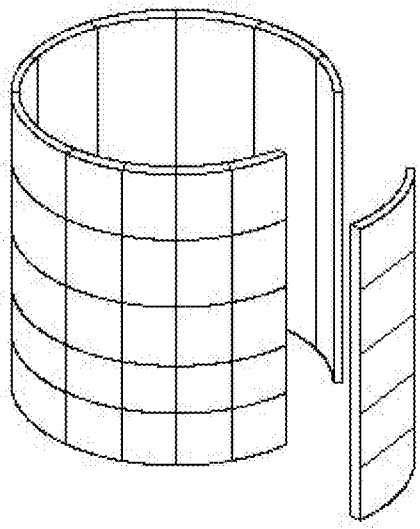
FIG. 10 is a schematic diagram of the installation process.

FIGS. 1-10 illustrate a modular indefinite volume combined tank, comprising a tank body module, a tank bottom module and an inflating module 2.

The tank body module is formed by splicing a plurality of wall plates 1 and connectors 10, the wall plates 1 are strip plates 1-1, four sides of the plates 1-1 are arranged with frame 1-2, and the two frames 1-2 in the width direction are arranged with a connector 1-3, the connector 1-3 is of a dumbbell structure (dumbbell structure means that both sides are wide and the middle is narrow; in the present invention, both sides of the dumbbell structure belong to triangular structure and the middle belongs to strip structure); the connector 10 includes a fixing bolt 10-3, an inner connecting piece 10-2 and an outer connecting piece 10-1, coaxial through-holes are arranged in the middle of the outer connecting piece 10-1 and inner connecting piece 10-2, the fixing bolt 10-3 passes through the through-hole of the outer connecting piece 10-1 and inner connecting piece 10-2 for fixed connection, the outer connecting piece 10-1 is of a dumbbell type, the inner connecting piece 10-2 is of a groove type, the gap between the outer connecting piece 10-1 and inner connecting piece 10-2 is wide in the middle and narrow at both ends, the connector 1-3 is fixed in the outer connecting piece 10-1 and inner connecting piece 10-2, in order to realize the function that the connector 10 fixes two adjacent wall plates 1; an annular tank body is formed by n wall plates 1 and n−1 connectors 10 (the number of n is not less than 8).

The tank bottom module comprises a strip-type steel plate 5, concrete cloth 4, annular steel plate and a cement foundation 6, wherein the cement foundation 6 is structured such that a round region is poured on the ground through cement; the strip-type steel plate is paved on the cement foundation 6, the strip-type steel plate is of a strip structure, the edge of the strip-type steel plate is arc-shaped, all strip-type steel plates form a steel plate area of a circular structure, the annular steel plate 3 is arranged in the upper side of the outer edge of the strip-type steel plate, the annular steel plate 3 is encircled by a plurality of arc-shaped steel sheets, a ring of annular edge is arranged in the annular steel plate 3 to be connected to the upper tank body, and a layer of concrete cloth 4 is arranged between the lower side of the annular steel plate 3 and the strip-type steel plate.

The inflating module 2 comprises a top cover 2-2 and a liner 2-1, wherein the top cover 2-2 is an inflated cover shaped like a pot cover, a cylindrical liner 2-1 is connected below the top cover, the liner 2-1 is also of an inflated structure, and inflating layers are arranged in the liner 2-1 and the top cover 2-2, the bottom of the liner 2-1 is arranged with a liquid inlet/outlet 11, the wall plate 1 corresponding to the liquid inlet/outlet 11 is arranged with an opening, the liquid inlet/outlet 11 of the liner 2-1 is arranged with quick coupling; an acid or alkali resistant layer is arranged inside the liner 2-1 and the top cover 2-2; the contact between the top cover 2-2 and the liner 2-1 is arranged with an inflating port 8, the wall plate 1 corresponding to the side face of the inflating port 8 is arranged with an opening, and the opening is arranged with inflating connector.

The bottom outer edge of the top cover 2-2 is arranged with a ring of rain shelter 2-3, the rain shelter 2-3 is of a solid structure, the bottom of the top cover 2-2 inclines towards the inclined lower part to cover the upper edge of the tank body. In rainy and snowy days, the rain can flow directly along the rain shelter 2-3, and no rain will be left on the top to cause the collapse of inflated top cover 2-2.

With regard to the steel plate area of a circular structure formed by strip-type steel plates 5, the diameter is 1.5-2 times of the external diameter of the annular steel plate 3. The size of the steel plate area of a circular structure should be ensured to be greater than the annular steel plate 3, so as to provide more stable support for the tank placed above.

The cement foundation 6 is externally arranged with a ring of cement cofferdam 7, the cofferdam 7 is of a slope structure, part of the cofferdam 7 is arranged at the edge of the steel plate area of a circular structure formed by strip-type steel plates, in order to compress the strip-type steel plate tightly for further fixation; meanwhile, the edge of the concrete cloth 4 is set up on the upper side of the cofferdam 7, in order to realize seepage-proofing.

Multiple reinforcing ribs are arranged on the wall plate 1, the reinforcing ribs are arranged horizontally, and the space between two adjacent reinforcing ribs is arranged with increasingly narrowed distance from top to down, so as to improve the resistance of the lower part of the tank body against water pressure.

The reinforcing rib can also be of X-shaped staggered structure, but the aforesaid space requirement should also be followed.

The inner sides of the outer connecting piece 10-1 and inner connecting piece 10-2 are both arranged with sealing strips 10-4. The sealing strip 10-4 on the outer connecting piece 10-1 covers the inner side of the outer connecting piece 10-1. The sealing strip 10-4 of the inner connecting piece 10-2 covers the inner side of the inner connecting piece 10-2 and the inner side face of the connector 1-3. Such design can realize the sealing of inner and outer layers on the largest scale, avoid leakage in case of emergency, and meanwhile reduce the friction and extrusion damage of the connector 1-3 and connector 10.

A bottom seal liner 9 is added below the liner 2-1, the bottom seal liner 9 is of a bowl structure, and the top thereof is located below the liquid inlet/outlet 11. The bottom seal liner 9 is of a solid structure and no inflation is required, further improving the auxiliary effect on the internal liner 2-1.

The joint installation method of the present invention is as follows:

first, select appropriate quantity of wall plate 1 and annular steel plate 3 based on the construction design requirements, and then process the tank bottom module at the construction area. Dig a hole and pave the cement to pave the strip-type steel plate, make the cofferdam 7, pave the concrete cloth 4, place the annular steel plate 3, assemble the wall plate 1 in the annular edge of the annular steel plate 3, then place the connector 1-3 of two adjacent wall plates 1 into the outer connecting piece 10-1 and inner connecting piece 10-2, and fix with bolt. Attention should be paid to the bolt direction and all bolts shall be from the inside to the outside, to avoid puncturing the liner 2-1. After the connection of all tank bodies and fixation, place into the bottom seal liner 9, place the inflating module 2 and put the liquid inlet/outlet 11 and inflating port 8 in place to align at the opening in the wall plate 1 for inflation. Later, adjust the inflated rain shelter 2-3 to cover the top of the tank, connect the pipeline, and start to be used as liquid storage.

With regard to tank body of the present invention, the internal hydraulic pressure will not vary with the diameter change due to the constant height of wall plate 1, so there is no need to consider the pressure change due to height change as the existing combined tank in the prior art.

What described above are only preferred embodiments of the present invention, which do not make any limitations to the present invention. The preferred embodiments are used to disclose the present invention, but not intended to limit the present invention. Those skilled in the art can make minor changes or modify as equivalent embodiments with equivalent alteration with the technical content disclosed above, without departing from the scope of the technical solution of the present invention. All minor amendments, equivalent alterations and modifications made for the above embodiments according to the technical essence of the present invention still fall within the scope of the technical solution provided by the present invention.

What is claimed is:

1. A modular indefinite volume combined tank, comprising:

a tank body module, a tank bottom module and an inflating module;

wherein the tank body module is formed by splicing a plurality of wall plates and connectors, the wall plates are strip plates, four sides of the plates are arranged with four frames, and two frames of the four frames in a direction parallel to the strip plates are arranged with a connector, the connector is of a dumbbell structure; the connector includes a fixing bolt, an inner connecting piece and an outer connecting piece, coaxial through-holes are arranged in the middle of the outer connecting piece and inner connecting piece, the fixing bolt passes through the through-hole of the outer connecting piece and inner connecting piece for fixed connection, the outer connecting piece is of a dumbbell shape, the inner connecting piece is of a groove shape, the gap between the outer connecting piece and inner connecting piece is wide in the middle and narrow at both ends, the connector is fixed in the outer connecting piece and inner connecting piece, in order to realize the function that the connector fixes two adjacent wall plates; an annular tank body is formed by n wall plates and n-1 connectors;

the tank bottom module comprises a strip-shape steel plate, concrete cloth, annular steel plate and a cement foundation, wherein the cement foundation is structured such that a round region is poured on the ground through cement; the strip-shape steel plate is paved on the cement foundation, the strip-shape steel plate is of a strip structure, the edge of the strip-shape steel plate is arc-shaped, all strip-shape steel plates form a steel plate area of a circular structure, the annular steel plate is arranged in the upper side of the outer edge of the strip-shape steel plate, the annular steel plate is encircled by a plurality of arc-shaped steel sheets, a ring of annular edge is arranged in the annular steel plate to be connected to the upper tank body, and a layer of concrete cloth is arranged between the lower side of the annular steel plate and the strip-shape steel plate; and the inflating module comprises a top cover and a liner, wherein the top cover is an inflated cover having a shape of a pot cover, a cylindrical liner is connected below the top cover, the liner is also of an inflated structure, inflating layers are arranged in the liner and the top cover, the bottom of the liner is arranged with a liquid inlet/outlet, the wall plate corresponding to the liquid inlet/outlet is arranged with an opening, the liquid inlet/outlet of the liner is arranged with quick coupling; an acid or alkali resistant layer is arranged inside the liner and the top cover; the contact between the top cover and the liner is arranged with an inflating port, the wall plate corresponding to a side face of the inflating port is arranged with an opening, and the opening is arranged with inflating connector.

2. The modular indefinite volume combined tank according to claim 1, wherein the bottom outer edge of the top cover is arranged with a ring of rain shelter, the rain shelter is of a solid structure, the bottom of the top cover inclines towards the inclined lower part to cover the upper edge of the tank body.

3. The modular indefinite volume combined tank according to claim 1, wherein with regard to the steel plate area of a circular structure formed by strip-shape steel plates, the diameter is 1.5-2 times of the external diameter of the annular steel plate.

4. The modular indefinite volume combined tank according to claim 3, wherein the cement foundation is externally arranged with a ring of cement cofferdam, the cofferdam is of a slope structure, part of the cofferdam is arranged at the edge of the steel plate area of a circular structure formed by strip-shape steel plates, in order to compress the strip-shape steel plate tightly for further fixation; meanwhile, the edge of the concrete cloth is set up on the upper side of the cofferdam, in order to realize seepage-proofing.

5. The modular indefinite volume combined tank according to any of claim 1, wherein multiple reinforcing ribs are arranged on each of the plurality of wall plates.

6. The modular indefinite volume combined tank according to claim 5, wherein the reinforcing ribs of the wall plate are arranged horizontally, and the space between two adjacent reinforcing ribs is arranged with increasingly narrowed distance from top to down, so as to improve the resistance of the lower part of the tank body against water pressure.

7. The modular indefinite volume combined tank according to claim 6, wherein the inner sides of the outer connecting piece and inner connecting piece are both arranged with sealing strips, the sealing strip on the outer connecting piece covers the inner side of the outer connecting piece, the sealing strip of the inner connecting piece covers the inner side of the inner connecting piece and the inner side face of the connector.

8. The modular indefinite volume combined tank according to claim 7, wherein a bottom seal liner is further added below the liner, the bottom seal liner is of a bowl structure, and the top thereof is located below the liquid inlet/outlet.

* * * * *